US007891992B2

(12) United States Patent
Veigel

(10) Patent No.: US 7,891,992 B2
(45) Date of Patent: Feb. 22, 2011

(54) PRESS-FIT CONTACT

(76) Inventor: Andreas Veigel, Amtgasse 1, Lenningen (DE) 73252

( * ) Notice: Subject to any disclaimer, the term of this patent is extended or adjusted under 35 U.S.C. 154(b) by 0 days.

(21) Appl. No.: 11/628,710

(22) PCT Filed: May 31, 2005

(86) PCT No.: PCT/EP2005/005824

§ 371 (c)(1),
(2), (4) Date: Dec. 7, 2006

(87) PCT Pub. No.: WO2005/122337

PCT Pub. Date: Dec. 22, 2005

(65) Prior Publication Data

US 2007/0218717 A1 Sep. 20, 2007

(30) Foreign Application Priority Data

Jun. 9, 2004 (DE) ..... 10 2004 028 202
Nov. 17, 2004 (DE) ..... 10 2004 055 548

(51) Int. Cl.
*H01R 12/00* (2006.01)

(52) U.S. Cl. ..... 439/82

(58) Field of Classification Search ..... 439/80–82, 439/751, 873, 943, 842
See application file for complete search history.

(56) References Cited

U.S. PATENT DOCUMENTS 3,717,841 A * 2/1973 Mancini ..... 439/842
3,846,741 A 11/1974 Kunkle et al.
4,513,499 A 4/1985 Roldan et al.
4,585,293 A 4/1986 Czeschka et al.
4,676,579 A * 6/1987 Ting ..... 439/82
4,737,114 A * 4/1988 Yaegashi ..... 439/82
4,923,414 A 5/1990 Sitzler et al.
5,145,407 A 9/1992 Obata et al.
5,823,830 A * 10/1998 Wurster ..... 439/78
5,893,779 A * 4/1999 Bianca et al. ..... 439/751
5,944,538 A 8/1999 Sorig et al.

FOREIGN PATENT DOCUMENTS

DE 202 18 295 U1 4/2003
EP 0 301 730 A 2/1989

OTHER PUBLICATIONS

International Search Report dated Aug. 29, 2005, issued in PCT/EP 2005/005824.

* cited by examiner

*Primary Examiner*—Felix O Figueroa
(74) *Attorney, Agent, or Firm*—Venable LLP; Robert Kinberg; Justine A. Gozzi

(57) ABSTRACT

A press-fit contact including a contact body with a square cross section and including a connecting region, a press-in region, and a tip region. Two legs are integrally formed within the contact body. The two legs originate at the connecting region and extend to the tip region where free ends of the two legs converge toward one another. The two legs are separated by a defined air gap in a longitude direction within the press-in region. The sum of the cross sections of the two legs substantially corresponds to the square cross section of the contact.

10 Claims, 3 Drawing Sheets

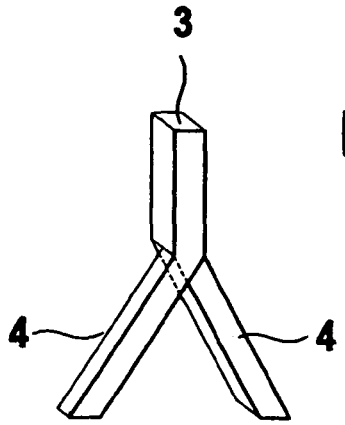
Fig. 6
Fig. 7
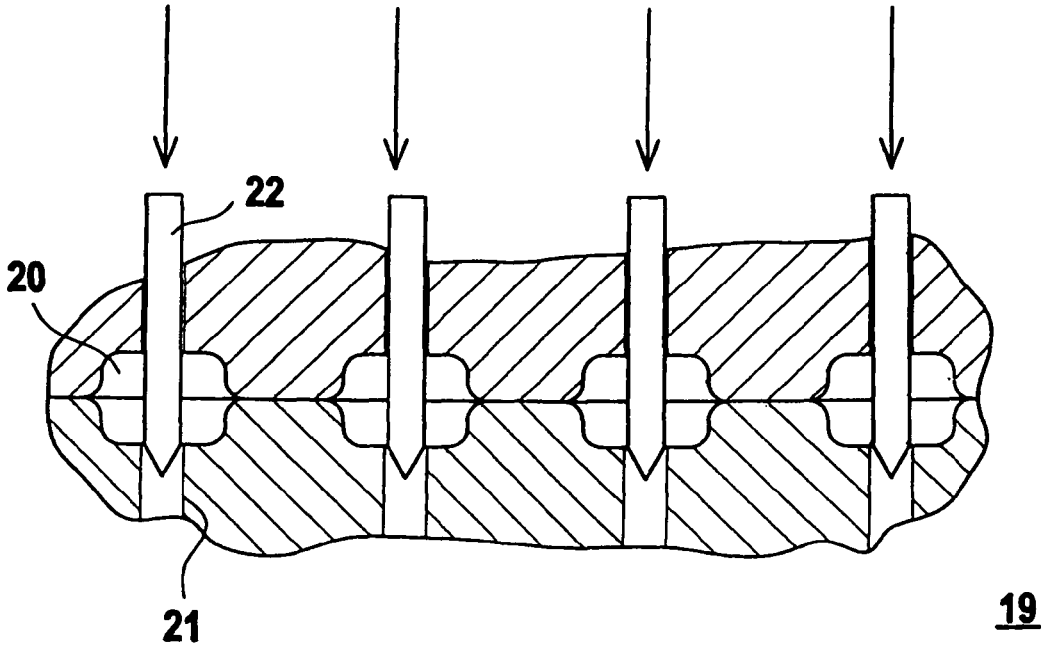

PRESS-FIT CONTACT

CROSS-REFERENCE TO RELATED PATENT APPLICATIONS

This application is a national stage application of PCT International Patent Application No. PCT/EP2005/005824 filed May 31, 2005 which claims the priority of the German Patent Application No. 102004028202.1 filed Jun. 9, 2004 and German Patent Application No. 102004055548.6 filed Nov. 17, 2004.

BACKGROUND OF THE INVENTION

The invention relates to a press-fit contact and a method for producing said contact.

Press-fit contacts of this type are used for producing non-soldered, electrical contacts, wherein these in particular are pressed into plated-through bores in circuit boards.

A distinction is made herein between press-fit contacts with solid press-in regions and those with elastic press-in regions, wherein these regions are positioned in the respective bores once the contact is pressed in. Solid press-in regions have considerable disadvantages as compared to elastic press-in zones because of their low resilience. In particular, bores can easily be damaged when pressing in press-fit contacts with solid press-in zones, thus resulting in impairing the contact to be established.

Punching techniques in particular can be used for producing press-fit contacts with elastic press-in regions. Press-fit contacts of this type have two legs in the press-in region, which are positioned at a distance to each other.

The legs of the press-fit contacts are produced by punching lateral recesses into a solid material, wherein a correspondingly large material surface is needed for punching out the opening between the legs. Accordingly, the press-fit contacts produced in this way generally have a flat, planar shape. When inserting these contacts into the circular bores, two contact surfaces are obtained between the press-fit contact and the wall of the bore, which are essentially offset by 180° relative to each other. The contact surfaces are formed by the narrow sides of the press-fit contact.

Since the press-fit contact fits only with its narrow sides against the wall of the bore, it results in an insufficient electrical contact that is prone to interference, in particular caused by tolerances of the individual components.

Document 3,846,741 A describes press-fit contacts, which are inserted into bores of circuit boards, wherein these are produced by bending metal strips. In particular, a press-fit contact can be formed using two metal strips, placed one above the other, for which the lower ends are bent in such a way that they form spaced-apart legs that are subsequently inserted under pressure into the respective bores.

This method also results in the production of elongated press-fit contacts having a geometry that is adapted insufficiently to the circular cross section of the bores.

SUMMARY

It is the object of the present invention to provide a press-fit contact which on the one hand can be produced cheaply and efficiently and, on the other hand, has good and reproducible mechanical and electrical contacting characteristics.

This object is solved with the features disclosed in claims 1 and 15, wherein advantageous embodiments and useful modifications of the invention are described in the dependent claims.

The press-fit contact according to the invention comprises a contact body and two legs, integrally formed with the body, which are separated by a separating surface that is formed without cutting, are expanded within a press-in region, and are arranged at a distance to each other. Furthermore provided is a tip, which adjoins the press-in region and is formed by the converging, free ends of the legs.

The press-fit contact according to the invention can be produced easily and efficiently. In the process, legs are worked into a contact body that forms a solid component by using a process without cutting, wherein these legs adjoin the remaining segment of the contact body. The legs are preferably produced through shearing of the contact body. A mandrel is advantageously used for the subsequent expanding of the legs in the press-in region.

It is advantageous if the tools used for this make it possible to simultaneously process several press-fit contacts and not just a single press-fit contact, thereby leading to an extremely efficient production of press-fit contacts.

A further and critical advantage of the press-fit contact according to the invention is that its shape can be adapted to the circular contour of the plated-through bore in a circuit board into which the contact must be inserted. As a result, an extremely high quality is achieved for the contacting which, in particular, is also mostly insensitive to tolerances of the individual contact components.

It is particularly advantageous that the press-fit contact according to the invention results in a high current carrying capacity for the established contact, which is required especially for high-current applications.

According to one particularly advantageous embodiment of the invention, the contact body for the press-fit contact has a square cross section. Owing to the fact that the legs are produced by cutting or especially shearing of one end of the contact body, the sum of the cross sections of the legs in the press-in region again corresponds at least approximately to the square surface of the contact body. This square cross sectional surface of the legs in the press-in region represents a geometrically optimum adaptation to the circular contour of the bore.

A symmetrical force distribution is consequently obtained for the contact forces that are effective between the legs of the press-fit contact and the wall of the bore. The contact forces in this case are effective in radial direction, relative to the center of the bore, wherein the contact locations between the press-fit contact and the bore are always offset by 90° relative to each other. This represents a symmetrical distribution of the contact forces and thus a torque-free and centered positioning of the press-fit contact inside the bore.

It is furthermore advantageous that a large conductor cross section is obtained within the bore as a result of the on the whole square surface area for the legs of the press-fit contact inside the bore. The conductor cross section can amount to approximately 60 to 80% of the bore cross section, depending on the permissible bore tolerances.

It is particularly advantageous if the outer edges of the legs of the press-fit contact each have a drawn or stamped radius at least in the press-in region. These radii form four large-surface gas-tight connections together with the wall of the bore, which are clearly delimited by clearance spaces. A corrosion-resistant contact which can be subjected to high currents is consequently established between press-fit contact and bore.

The insertion of the press-fit contact into the respective bore is made considerably easier if the free ends of the press-fit contact are embodied such that they form a tip.

According to one advantageous embodiment, the free ends of press-fit contacts that is inserted into the bore extend past the underside of the bore. These can subsequently be bent up and pressed against the lower edge of the bore, thereby creating a form-fitting connection between the bent tip and the circuit board. The connection formed in this way corresponds to a riveted connection and results in an extremely good hold of the press-fit contact in the bore. In principle, press-fit contacts can thus also be used as purely mechanical fixing elements, without electrical function.

The press-fit contact according to a particularly advantageous embodiment of the invention has a connecting region, formed by the contact body and the adjoining leg segments which are positioned closely together. The connecting region is adjoined by the leg segments, which form the press-in region and are expanded relative to each other. The leg segments that form the connecting region permit an efficient compensation of tolerances, achieved by the separation of the legs in the connecting region, which reduces the rigidity of the press-fit contact in the connecting region. As a result, it is ensured that the permissible forces acting upon the circuit board and the press-in region are not exceeded during the insertion, even with a tolerance-related axial misalignment between the press-fit contact and the bore.

It is generally advantageous if the press-in region of the press-fit contact according to the invention has good elastic properties because of its shape. As a result, the press-fit contact can also be fashioned in particular from brass, meaning a material with poor resilience characteristics but extremely high conductive values, instead of the standard materials such as copper alloys.

BRIEF DESCRIPTION OF THE DRAWINGS

The invention is explained in the following with the aid of the drawings, which show in:

FIG. 6: A contact body with legs emanating from it, which is produced with the aid of the shearing tool shown in FIG. 5;

FIG. 7: A cross section through a tool for expanding the legs of the contact body according to FIG. 5.

DETAILED DESCRIPTION

Figure 1A:
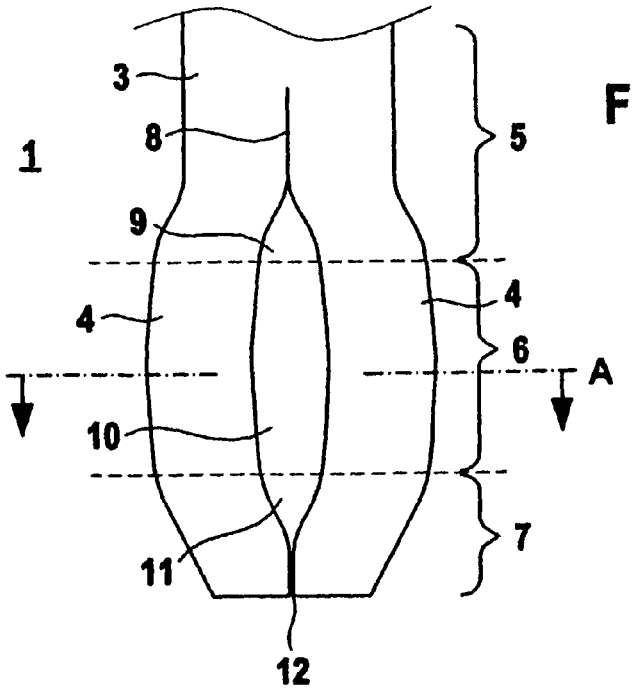
FIG. 1*a*: A schematic representation of an exemplary embodiment of the press-fit contact according to the invention.
Figure 1B:
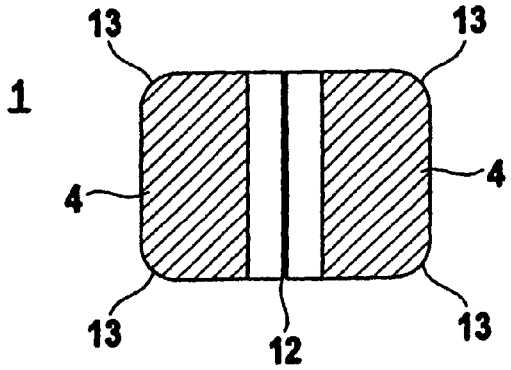
FIG. 1*b*: A cross section through the press-fit contact according to FIG. 1.

FIGS. 1*a* and 1*b* show an exemplary embodiment of a press-fit contact 1. FIG. 1*a* shows a view from the side of the press-fit contact 1 while FIG. 1*b* shows a cross section along the line A in FIG. 1*a*. The press-fit contact 1 can be inserted into a plated-through bore 2 of a circuit board, as shown schematically in FIG. 2, wherein the bore 2 has a circular cross section.

The press-fit contact 1 in the present case is a part composed of brass, wherein this press-fit contact 1 consists of a contact body 3 with two legs 4 that freely emanate from its underside. The legs 4 are formed by cutting or shearing a segment of the contact body 3 along a separating surface, so that the legs 4 adjoin the remaining solid segment of the contact body 3. The legs 4 consequently are formed integrally with the contact body 3. The legs 4 are identical and are embodied symmetrical to the symmetry plane extending in longitudinal direction of the press-fit contact 1.

The contact body 3 has a rectangular cross section, which for the present case is a constant, square cross section. Since the legs 4 are formed by shearing or cutting from the contact body 3, the legs respectively have a constant rectangular cross section in longitudinal direction, wherein these cross sections add up to form the square cross section of the contact body 3. The cross sections can be tapered slightly, but only in the region of the free ends of the legs 4, so as to facilitate the insertion of the press-fit contact 1 into the bore 2.

The press-fit contact 1 is divided into different regions, as shown in FIG. 1*a*, namely a connecting region 5 at its upper end, an adjoining press-in region 6, as well as a tip 7 at its lower end.

The connecting region 5, which functions to make possible the electrical connection of external units to the press-fit contact 1, consists of the solid contact body 3, as well as the adjoining upper segments of the legs 4, which are positioned against each other, separated only by an interface 8. The connecting region 5 is completed by the region of the legs 4, which move apart starting from the interface 8, thus enclosing an intermediate space in the shape of a spandrel 9.

In the adjoining press-in region 6, the legs 4 are expanded by means of suitable tools and are positioned at some distance to each other. The legs 4 consequently form an elastic press-in region 6. As a result of the processing with the tools, the insides have a smooth surface in this region. The legs 4 form an eyelet in the press-in region 6, wherein the outer dimensions of this eyelet exceed the diameter of the bore 2 into which the press-fit contact 1 must be inserted. The space between the legs 4 in the press-in region 6 forms a defined area of expansion 10. The press-in region 6 is followed by the tip 7 of the press-fit contact 1, wherein this tip 7 is formed by the free ends of the legs 4. In the upper region of the tip 7, the legs 4 converge with predetermined angles of inclination and enclose an intermediate space in the form of a spandrel 11. At the front end of the tip 7, the free ends of the legs 4 essentially extend parallel, wherein the legs 4 are separated by a separating gap 12. FIG. 1*b* in particular shows that the outside edges of the legs 4 have radii 13 in the press-in region 6, wherein the outside edges of the press-fit contact 1 in principle can be provided over the complete length with drawn or stamped-on radii 13. In the present case, the outside edges of the legs 4 are provided with radii 13 in the press-in region 6, which are created in a separate processing step.

The press-fit contact 1 is inserted into the bore 2 by initially inserting the tip 7 of the press-fit contact 1 into the bore 2. Since the cross sections of the legs 4 are reduced in the region of the tip 7, and the free ends of the legs 4 converge, their outside dimension is smaller than the diameter of the bore 2, thereby ensuring an easy insertion of the tip 7 into the bore 2.

Figure 2:
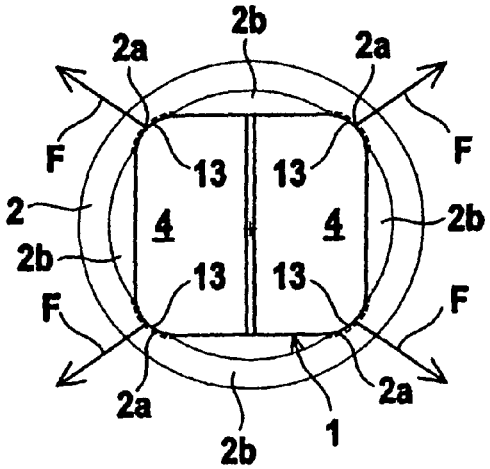
FIG. 2: A cross section through a bore in a circuit board, with therein inserted press-fit contact according to FIGS. 1*a, b;*

The press-in region 6 of the press-fit contact 1 is subsequently inserted into the bore 2, wherein during the insertion of the legs 4, these are pressed against each other in the press-in region 6, as shown in FIG. 2, and come to rest in the bore 2.

As a result of the close positioning, separated by the interface 8, of the segments of the legs 4 in the connecting region 5, the elastic properties of the press-fit contact 1 are improved so as to compensate for tolerances. It means that the rigidity of the press-fit contact 1 is reduced in the connecting region 5. As a result, the permissible forces acting upon the circuit board and the press-in region 6 are not exceeded during the insertion, even with a tolerance-dependent axial misalignment between the press-fit contact 1 and the bore 2, particularly for arrangements having multiple press-fit contacts 1.

FIG. 2 shows the legs 4 inserted into the bore 2 in the press-in region 6. Since the legs 4 are created by cutting or shearing from the contact body 3 and since this body has a square cross section, the legs 4 complement each other in the press-in region 6 to form the same square cross-sectional surface, which is optimally adapted to the geometry of the circular bore 2. The geometry of the legs 4 allows the contact forces F between the press-fit contact 1 and the bore 2 to be effective in radial direction and rotation-symmetrical, relative to the center of the bore 2, as shown in FIG. 2. A torque-free, secure positioning of the press-fit contact 1 in the center is thus achieved in the bore 2. The radii 13 of the legs 4 furthermore form large-surface, gas-tight contact surfaces 2*a* with the bore 2. The contact surfaces 2*a* are clearly delimited by adjoining clearance spaces 2*b*, which results in a defined surface pressure between press-fit contact 1 and bore 2. During the insertion, contamination and foreign substance layers can be displaced into the clearance spaces 2*b*. The sum of the contact surfaces 2*a* of the gas-tight connections created in this way as a rule is higher than the cross section of the press-fit contact 1. This results in an extremely low electrical transition resistance and a correspondingly high current carrying capacity. Finally, the square cross-sectional arrangement of the legs 4 results in a large conductor cross section within the smallest possible bore 2.

The tip 7 of the press-fit contact 1 that is inserted into the bore 2 extends somewhat past the lower edge of the bore 2. If need be, the free ends of the legs 4 can be bent up and pressed against the edge of the bore 2, thus creating a rivet-type connection which provides a further improved mechanical hold for the press-fit contact 1.

FIGS. 3 to 7 show the method for producing the press-fit contact 1 according to FIGS. 1*a* and 1*b*.

Figure 3:
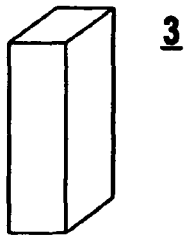
FIG. 3: A schematic representation of a contact body for producing a press-fit contact according to FIG. 1.

FIG. 3 shows the starting material for producing a press-fit contact 1, namely a contact body 3 in the form of a solid brass part. In the present case, this contact body 3 has a constant square cross section over its length. The outside edges of the contact body 3 can be provided with drawn or stamped radii 13.

Figure 4:
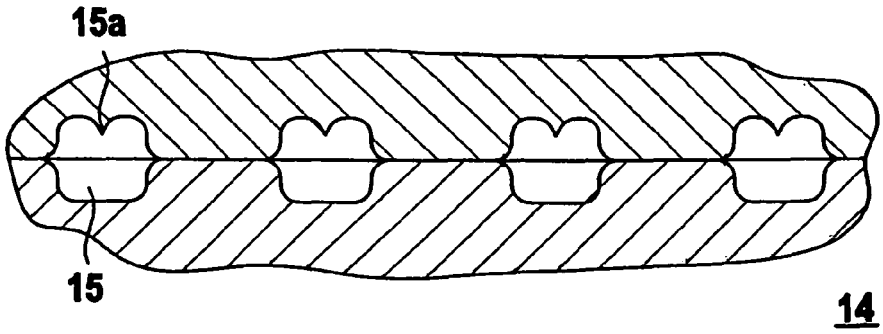
FIG. 4: A cross section through a stamping tool for stamping contact bodies according to FIG. 3.
Figure 5:
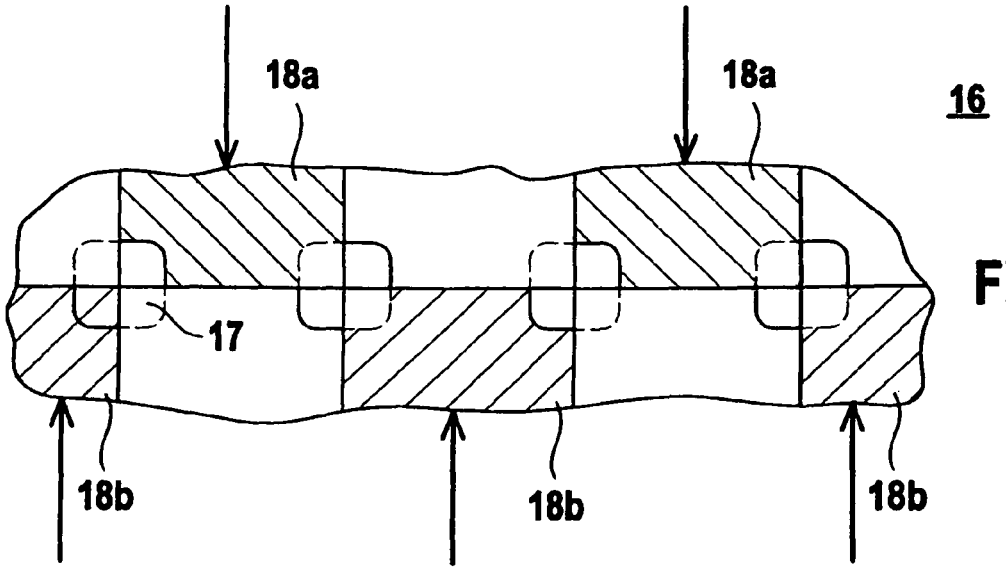
FIG. 5: A cross section through a shearing tool used for the shearing of contact bodies according to FIG. 3.

FIGS. 4, 5 and 7 show cross-sectional views of tools for producing a press-fit contact 1 from the contact body 3, using a process without cutting. The tools are embodied such that they can be used to process several contact bodies 3 at the same time, so as to produce in particular grid-type arrangements of several press-fit contacts 1. FIGS. 4, 5, 7 show tools that are used for the simultaneous processing of respectively four contact bodies 3, wherein the number of simultaneously processed contact bodies 3 can in principle also vary.

FIG. 4 shows a stamping tool 14. This stamping tool 14 is provided with four stamping molds 15 for holding the contact bodies 3. The longitudinal axis of a contact body 3 that is positioned inside a stamping mold 15 extends perpendicular to the drawing plane. The stamping molds 15 are adapted to the cross sections of the contact body 3. As a result of the rounded edges of the stamping molds 15, radii 13 are stamped onto the outside edges of the contact body 3 in the press-in region 6 of the respectively projecting press-fit contact 1. Each stamping mold 15 furthermore is provided with at least one projection 15*a* that causes a notching into the respective contact body 3.

The contact bodies 3 are then processed with the aid of the shearing tool 16 shown in FIG. 5. The shearing tool 16 is provided with receptacles 17 for the contact bodies 3, as well as an arrangement of shearing stamps 18*a, b*, wherein these are first shearing stamps 18*a* which move from the top downward in the drawing plane, shown in FIG. 5 for shearing a contact body 3, as well as second shearing stamps 18*b* which move from the bottom upward.

Each contact body 3 respectively fits against a first and a second shearing stamp 18*a, b* in the receptacle 17, wherein the longitudinal axis of the contact body 3 extends perpendicular to the drawing plane. As a result of opposite directed shearing movements of a first and second shearing stamp 18*a, b*, acting upon a contact body 3, the lower region of a contact body 3 is sheared to form two legs 4, which are separated by a separating surface. The contact body 3 with the two legs 4, obtained after a shearing operation, is shown in FIG. 6. As a result of the design of the shearing stamps 18*a, b*, the legs 4 extending outward from the contact body 3 form a v-shaped arrangement.

For the further processing of the contact bodies 3 in the expanding tool 19, shown in FIG. 7, the legs 4 of the contact body 3 are bent toward each other, so that these fit once more against each other. The contact bodies 3 which are pre-processed in this way are inserted into receptacles 20 of the expanding tool 19. The longitudinal axes of the contact bodies 3 positioned therein extend perpendicular to the drawing plane.

Extending outward from the receptacles 20 are channels 21 into which respectively one mandrel 22 is inserted for expanding the legs 4 in the press-in region 6 of the press-fit contact 1. Since the legs 4 are pushed apart during the expanding with the mandrel 22, the widths of the receptacles 20 exceeds the width of the contact body 3, so that the legs 4 can escape to the side when the mandrel 22 is pushed in. The intermediate region that forms the expanding region 10 between the legs 4 in the press-in region 6 is determined by the shape of the mandrel 22. The inside areas of the legs 4 are smoothed as a result of the processing with the mandrel 22. The notching inserted into the contact body 3 with the stamping tool 14, as shown in FIG. 3, is used as insertion aid for the mandrel 22. With the tools shown in FIGS. 4, 5, 7, the press-fit contact 1 can be produced easily and efficiently, without requiring any additional processing steps.

The invention claimed is:

1. A press-fit contact insertable into a bore of a circuit board, comprising:

a body with a square cross sectional area having four rounded exterior radial edges that form contact surfaces with the circuit board, wherein two legs are formed monolithically within the body in a longitudinal direction, the legs including free ends that converge toward each other, the body including a connecting region in which the legs originate, the connecting region including adjoining upper segments of the legs that abut against each other, a press-in region adjoining the connecting region in the longitudinal direction, wherein in the press-in region the two legs are arranged at a distance from each other and wherein the four rounded edges extend a complete length of the press-in region, and a tip region adjoining the press-in region in the longitudinal direction, the tip region including the free ends of the legs;

wherein the two legs extend from the connecting region to the tip region, wherein the free ends are at a distance farthest from the connecting region towards the tip region in the longitudinal direction wherein no portion of the body extends beyond the free ends in the longitudinal direction, wherein the body defines a continuous air gap which extends from the connecting region through the press-in region to the tip region, and a sum of a cross sectional area of each leg substantially corresponds to the square cross sectional area of the body, and wherein a symmetrical force distribution with respect to a central point of the press in region is obtained for the contact forces between the press in region of the body and the circuit board.

2. The press-fit contact according to claim 1 forming a combination with the circuit board including the plated-through bore, wherein the contact is inserted into the plated-through bore of the circuit board.

3. The press-fit contact according to claim 1, wherein each leg has a constant cross sectional area in the press-in region, a sum of the cross sectional areas of the legs being substantially equal to the cross sectional areas of the body.

4. The combination according to claim 2, wherein the exterior radial edges of the legs are respectively provided with a substantially identical radius at least in the press-in region.

5. The combination according to claim 4, wherein the legs in the press-in region form an eyelet, having an outside diameter that is larger than a diameter of the circuit board defining the bore.

6. The combination according to claim 4, wherein following the insertion into the bore, the legs contact the bore in the press-in region.

7. The combination according to claim 6, wherein following the insertion into the bore, the exterior radial edges of the legs form a gas-tight connection with a wall of the circuit board.

8. The combination according to claim 7, wherein the circuit board defining the bore has a circular cross section and wherein the legs pressed into the bore exert contact forces extending in a radial direction onto the wall of the circuit board.

9. The press-fit contact according to claim 2, wherein following the insertion into the bore, the free ends of the legs that extend past the bore are bent up toward an edge of the bore.

10. The press-fit contact according to claim 1, wherein the contact comprises a brass part.

* * * * *